US009352898B2

(12) United States Patent
Glass et al.

(10) Patent No.: US 9,352,898 B2
(45) Date of Patent: May 31, 2016

(54) FLIPOVER BOX CARD HOLDER ASSEMBLY

(75) Inventors: Brett R. Glass, Overland Park, KS (US); Nicole E. Glass, Overland Park, KS (US)

(73) Assignee: GIFT CARD IMPRESSIONS, LLC, Kansas City, MO (US)

( * ) Notice: Subject to any disclaimer, the term of this patent is extended or adjusted under 35 U.S.C. 154(b) by 54 days.

(21) Appl. No.: 13/594,868

(22) Filed: Aug. 26, 2012

(65) Prior Publication Data

US 2013/0220880 A1 Aug. 29, 2013

Related U.S. Application Data

(60) Provisional application No. 61/527,134, filed on Aug. 25, 2011.

(51) Int. Cl.

| | |
|---|---|
| ***B65D 25/00*** | (2006.01) |
| ***B65D 85/00*** | (2006.01) |
| ***B65D 5/38*** | (2006.01) |
| ***B65D 5/42*** | (2006.01) |
| ***B65D 5/52*** | (2006.01) |

(52) U.S. Cl.
CPC *B65D 85/00* (2013.01); *B65D 5/38* (2013.01); *B65D 5/4208* (2013.01); *B65D 5/5213* (2013.01)

(58) Field of Classification Search
CPC ..... B65D 5/5246; B65D 5/522; B65D 5/38; B65D 5/4208; B65D 5/5213
USPC ..... 206/767, 768, 755, 528, 45.29, 206/772–774, 110, 467, 468, 539, 831, 536, 206/538, 555, 39, 39.4, 39.6, 485, 531, 1.5, 206/736; 40/490, 491; 229/125.125
See application file for complete search history.

(56) References Cited

U.S. PATENT DOCUMENTS

| | | | | |
|---|---|---|---|---|
| 475,918 | A * | 5/1892 | Barker | 229/125.125 |
| 639,679 | A | 12/1899 | Kaufmann | |
| 1,544,463 | A | 6/1925 | Lengsfield | |
| 1,568,982 | A | 1/1926 | Lengsfield | |
| 1,860,586 | A * | 5/1932 | McIlhenney | 206/772 |
| 1,937,222 | A * | 11/1933 | Gallahan | 206/254 |
| 2,058,608 | A | 10/1936 | Maeda | |
| 2,884,724 | A | 5/1959 | Lohnes et al. | |
| 3,199,238 | A | 8/1965 | Brown | |

(Continued)

FOREIGN PATENT DOCUMENTS

| | | | |
|---|---|---|---|
| CA | 2 447 733 | C | 3/2012 |
| WO | 20081020883 | A2 | 2/2008 |

OTHER PUBLICATIONS

Office Action from related U.S. Appl. No. 13/294,063, dated Jun. 3, 2015; 8 pgs.

(Continued)

*Primary Examiner* — Luan K Bui
*Assistant Examiner* — Rafael Ortiz
(74) *Attorney, Agent, or Firm* — Polsinelli PC

(57) ABSTRACT

An assembly for holding a transaction card, such as a gift card, within a sliding box assembly. The sliding box assembly includes a sliding tray portion that fits into, and slides within, an outer sleeve. The tray portion fits entirely within the sleeve when the assembly is in a closed disposition. When the tray is withdrawn from the sleeve, a panel holding a removably attached transaction card flips over to present the card in an outward disposition.

10 Claims, 4 Drawing Sheets

(56) References Cited

U.S. PATENT DOCUMENTS

| | | | | |
|---|---|---|---|---|
| 3,380,575 | A | 4/1968 | Hennessey | |
| 3,684,084 | A * | 8/1972 | Kanzelberger | 206/773 |
| 3,743,084 | A * | 7/1973 | Douglas | 206/532 |
| 3,755,925 | A | 9/1973 | Court | |
| 3,848,348 | A | 11/1974 | Hawley | |
| 4,697,364 | A | 10/1987 | Dean | |
| 5,277,307 | A | 1/1994 | Kelly | |
| 5,289,917 | A | 3/1994 | Chabria | |
| 5,400,914 | A | 3/1995 | Lin | |
| 5,497,876 | A | 3/1996 | Fleming | |
| 5,575,384 | A | 11/1996 | Saye | |
| 6,237,265 | B1 * | 5/2001 | Crowell | 40/491 |
| 6,418,648 | B1 | 7/2002 | Hollingsworth et al. | |
| 6,527,111 | B2 | 3/2003 | Leung et al. | |
| 6,732,459 | B1 | 5/2004 | Clark | |
| 6,877,263 | B2 | 4/2005 | Clark | |
| 6,994,246 | B2 * | 2/2006 | Ichikawa et al. | 229/117.22 |
| 7,056,122 | B2 | 6/2006 | Lockett | |
| D532,452 | S | 11/2006 | Heng et al. | |
| 7,275,683 | B2 | 10/2007 | Lazarowicz et al. | |
| 7,694,445 | B2 * | 4/2010 | Kelly | 40/491 |
| D619,359 | S | 7/2010 | Pascua et al. | |
| 7,882,651 | B2 | 2/2011 | Wilen | |
| 2003/0098356 | A1 * | 5/2003 | Gombar | 235/492 |
| 2005/0284927 | A1 | 12/2005 | Wilen | |
| 2006/0101678 | A1 | 5/2006 | Wilen | |
| 2006/0231609 | A1 | 10/2006 | Lazarowicz et al. | |
| 2007/0094901 | A1 | 5/2007 | Kibbe et al. | |
| 2008/0047175 | A1 * | 2/2008 | Kelly | 40/124.19 |
| 2008/0156686 | A1 * | 7/2008 | Hluchan et al. | 206/528 |
| 2009/0065390 | A1 * | 3/2009 | Oono et al. | 206/555 |
| 2009/0217559 | A1 | 9/2009 | Sayre | |
| 2010/0224516 | A1 | 9/2010 | Abell | |
| 2012/0285967 | A1 | 11/2012 | Glass et al. | |

OTHER PUBLICATIONS

Office Action from related U.S. Appl. No. 13/294,063, dated Dec. 18, 2014; 7 pgs.

Office Action from related U.S. Appl. No. 13/294,063, dated Jun. 9, 2014; 9 pgs.

Office Action from related U.S. Appl. No. 13/294,063, dated Nov. 21, 2013; 7 pgs.

Office Action from related U.S. Appl. No. 13/294,063, dated May 24, 2013; 6 pgs.

* cited by examiner

FLIPOVER BOX CARD HOLDER ASSEMBLY

CROSS REFERENCE TO RELATED APPLICATIONS

This application claims the benefit of the prior filed, provisional application, Ser. No. 61/527,134, filed Aug. 25, 2011, incorporated by reference herein.

BACKGROUND OF THE INVENTION

This invention relates generally to transaction card holders and more particularly to an assembly for holding a transaction card, such as a gift card, within a sliding box assembly that causes a panel holding the gift card to flip over and present the card when an internal tray of the assembly is withdrawn from an outer sleeve of the assembly.

Transaction cards, stored value cards, or gift cards, as they are commonly called based upon their intended use, have become popular gifts. Gift cards typically comprise a stored value card whereby a certain cash equivalent value is encoded upon a magnetic strip applied to the surface of the card. This stored value may be determined by the vendor prior to packaging and display for sale or, more commonly, is selected at the point of sale by the purchaser and loaded by the cashier using a magnetic card reader/writer. While popular, gift cards are typically provided with a generic and impersonal design, typically identifying the associated merchant for which the card may be used to purchase merchandise, and therefore are not personalized in view of the intended recipient.

Gift cards are often presented for sale on display racks in stores, each card or packet of cards being hung upon a display stand peg. A given area of a store will only support a certain number and size of display stands, given store traffic and other considerations, which makes allocation of display space an important marketing decision that may require selecting only certain high selling cards for display. Display of other items in the same store area will typically reduce the substantially finite space available for displaying gift cards and gift card packets.

What is needed, therefore, is a device that displays a gift card for purchase when hung upon a display rack within a predetermined and allotted display space but that converts to an enhanced gifting assembly after purchase, removal of the header panel, and installation of the gift card within the assembly.

BRIEF DESCRIPTION OF THE INVENTION

The purpose of this invention is to provide an assembly for holding a transaction card, such as a gift card, within a sliding box assembly. The sliding box assembly includes a sliding tray portion that fits into, and slides within, an outer sleeve. Typically, the tray fits entirely within the sleeve when the assembly is in a closed disposition. When the tray is withdrawn from the sleeve, a panel holding a gift card is caused to flip over and present the gift card in an outward disposition.

An embodiment of a holder according to the present invention may include a generally rectangular sliding tray portion and an outer sleeve portion that receives the tray portion. An articulating panel is pivotally attached to and extends from the tray portion to pivotally attach to the sleeve portion. The articulating panel includes means for removably retaining a card thereon. When the tray portion is withdrawn from the sleeve portion, the articulating panel pivots outward from an inner, storage position to an outer, presentation position. If a card is retained upon the articulating panel, it is thereby displayed in a presentation position for viewing by the user.

Other advantages of the invention will become apparent from the following description taken in connection with the accompanying drawings, wherein is set forth by way of illustration and example an embodiment of the present invention.

DETAILED DESCRIPTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
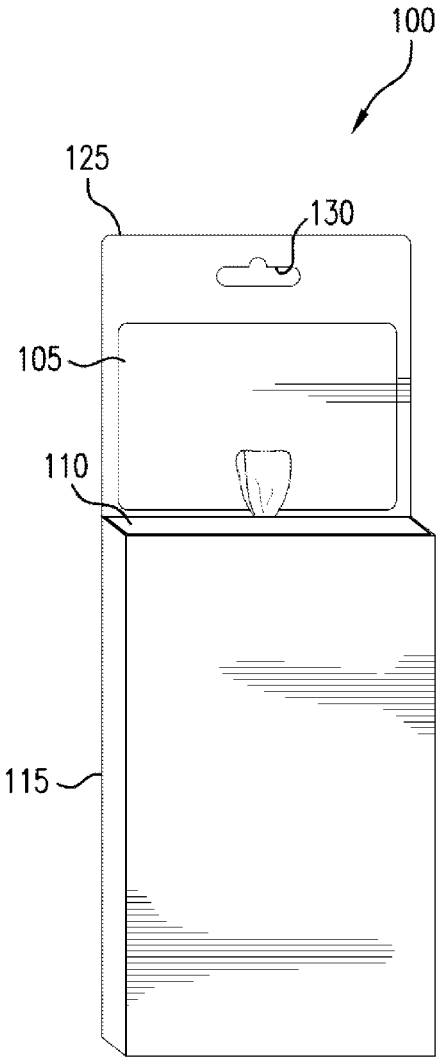
FIG. 1 is a front perspective view of a flipover box card holder assembly showing the assembly in a closed disposition for display upon a merchant display rack.
Figure 2:
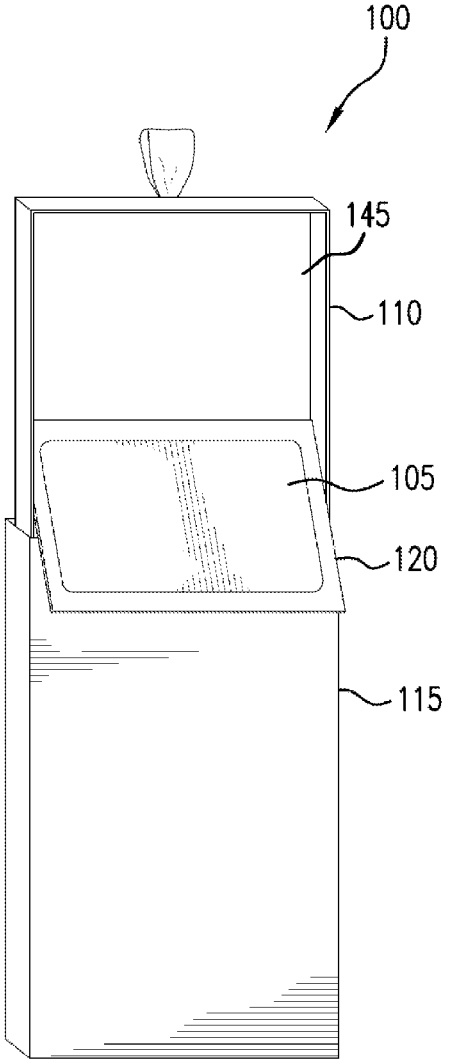
FIG. 2 is a front perspective view of the assembly showing the tray in an extended position and the gift card removed from the header panel and installed upon the gift card holding panel.

With reference to the figures, FIGS. 1-9 are illustration of one or more embodiments of a flipover box card holder assembly 100 (also referred to herein as a sliding box assembly 100) for holding a transaction card such as a gift card 105. FIG. 1 is a front perspective view of the assembly 100 showing the assembly 100 in a closed disposition for display upon a merchant display rack (not shown). The assembly 100 includes a generally rectangular sliding tray portion 110 that fits into, and slides within, an outer sleeve portion 115 that is constructed to receive and hold the tray 110. Typically, the tray 110 fits entirely within the sleeve 115 when the assembly is in a closed disposition. When the tray 110 is withdrawn from the sleeve, the articulated panel (card holder panel 120) holding the gift card 105 is caused to flip over and present the gift card 105 in an outward disposition as shown in FIG. 2. FIG. 2 is a front perspective view of the assembly 100 showing the tray 110 in an extended position and the card holder panel 120 in a presentation disposition.

Figure 4:
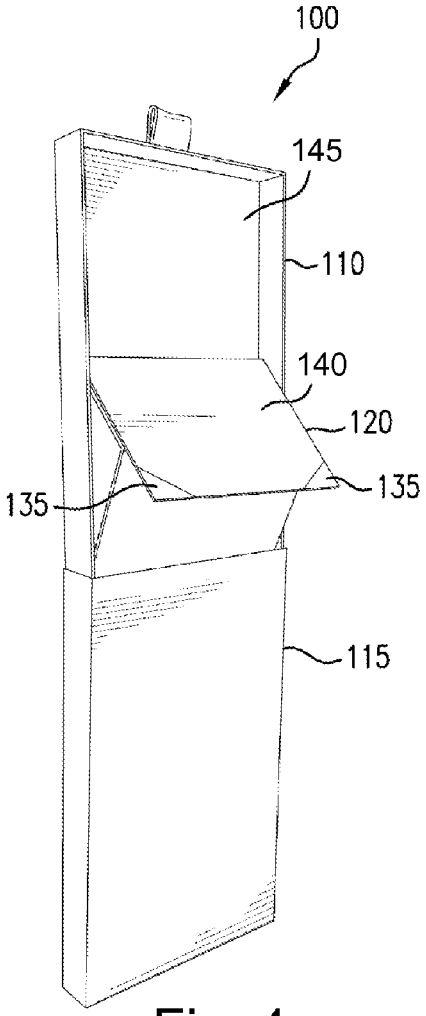
FIG. 4 is a front and left side perspective view of the assembly showing the tray in a fully extended position with the card holder panel having flipped over to reveal the attached gift card.

As shown in FIG. 1, the assembly includes a header panel 125 that is attached to the outer back surface of the sleeve 115. The header panel 125 includes an aperture, such as the illustrated sombrero cut hole 130 for receiving a display peg (not shown) when the assembly is hung upon a display rack or stand at a merchant location. After purchase of the assembly 100, a user removes the gift card 105 from the header panel 125 (the card 105 is typically attached to the front surface of the header panel 125 using removable adhesive) and the gift card 105 is installed upon the card holder panel 120 as shown in FIG. 2. As shown in FIG. 4, the card holder panel 120 may be provided with corner pockets 135 for receiving the lower corners of a gift card 105 and retaining it it upon the card holder panel 120. Alternative means for holding the gift card 105 in position may be employed such as removable adhesive applied to the presentation surface 140 of the card holder panel 120, or opposed slits in the presentation surface 140 for receiving two or more corners of a card 105.

Figure 3:
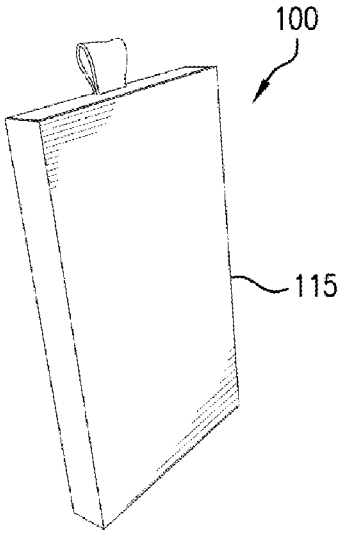
FIG. 3 is a front and left side perspective view showing the assembly in a closed disposition and with the header panel removed.
Figure 5:
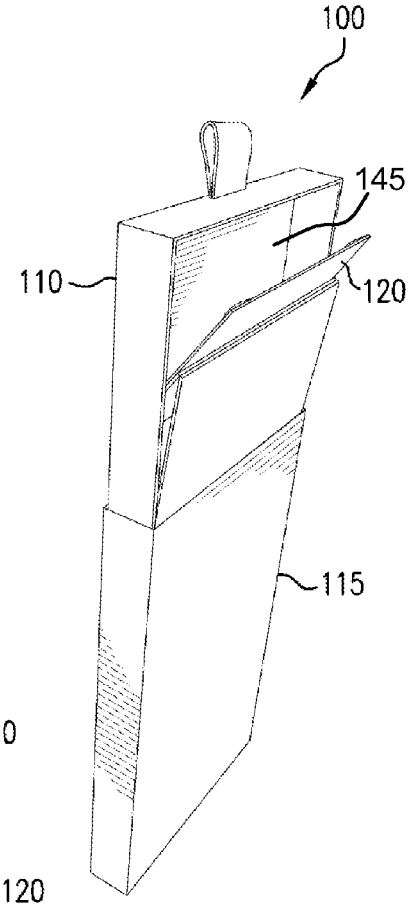
FIG. 5 is a front and left side perspective view of the assembly showing the tray in a partially extended position with the card holder panel still facing the bottom of the tray.

FIG. 3 is a front and left side perspective view showing the assembly 100 in a closed disposition and with the header panel 125 removed. The header panel 125 may include perforations to enable a user to tear the header panel 125 away from the sleeve 125. FIG. 5 is a front and left side perspective view of the assembly 100 showing the tray 110 in a partially extended position with the card holder panel 120 still facing the bottom panel 145 of the tray 110.

FIG. 4 is a front and left side perspective view of the assembly 100 showing the tray 110 in a fully extended position with the card holder panel 120 having flipped over to reveal the attached gift card 105.

Figure 8:
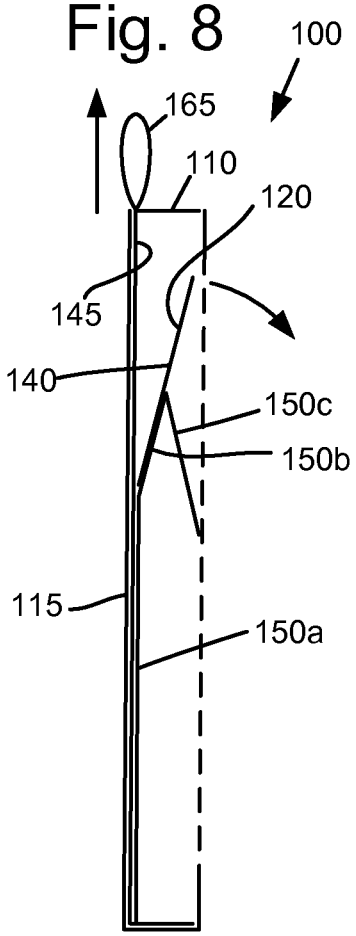
FIG. 8 is a cross sectional diagram showing an assembly in a closed disposition.

FIG. 8 is a cross sectional diagram showing an assembly 100 in a closed disposition. The embodiment illustrated diagrammatically in FIGS. 8 and 9 includes a mechanical panel 150 that directly provides the action that causes the card holder panel 120 to flip or turn over to present an attached gift card 105. A mechanical panel 150 may include three hinged segments connected to one another along fold lines. A first segment 150*a* is attached to the tray 110, typically at the back wall or bottom panel 145 thereof. A second segment 150*b* extends from the first segment 150*a* and is free, by which is meant that it is not attached to either the tray 110 or sleeve 115. A third segment 150*c* extends from the second segment 150*b* and is slidably engaged with the sleeve 115. In the present embodiment, the third segment 150*c* includes tabs that engage a track panel 155 within the sleeve 115. The tabs fit into elongated slits 160 within the track panel 155 that allow the third segment 150*c* to slide along the track panel 155, up or down, as the tray 110 is extended or retracted from the sleeve 115.

Figure 9:
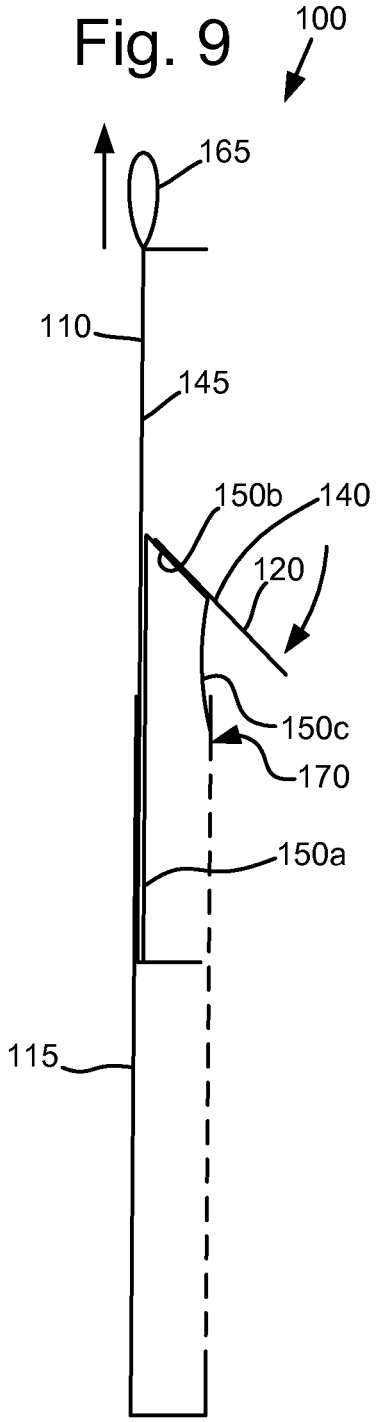
FIG. 9 is a cross sectional diagram showing an assembly in an open or extended disposition.

As illustrated in FIG. 9, as the tray 110 is pulled upward and out of the sleeve 115, typically by grasping and pulling a paper, plastic or fabric loop 165 attached to the upper margin of the tray 110, to an open or extended disposition, the third segment 150*c* rides along the track panel 155 until the tabs abut the upper margins or ends 170 of the slits 160. With further upward movement of the tray 110, the third segment 150*c* (which is now unable to travel further upward and is stationary relative to the sleeve 115) pulls the proximate, hingedly connected edge of the second segment 150*b* downward, thereby causing the second segment 150*b* to pivot downward about the hinge or fold line between the second segment 150*b* and the first segment 150*c*. Since the card holder panel 120 is mounted on the outer, generally upward, surface of the second segment 150*b*, the card holder panel 120 and any attached gift card 105 are also pivoted from a closed position in which the gift card 105 and presentation surface 140 face the bottom panel 145, to an open, presentation position, in which the presentation surface 140 and any gift card 105 mounted thereon face upward and outward and away from the bottom panel 145.

Figure 7:
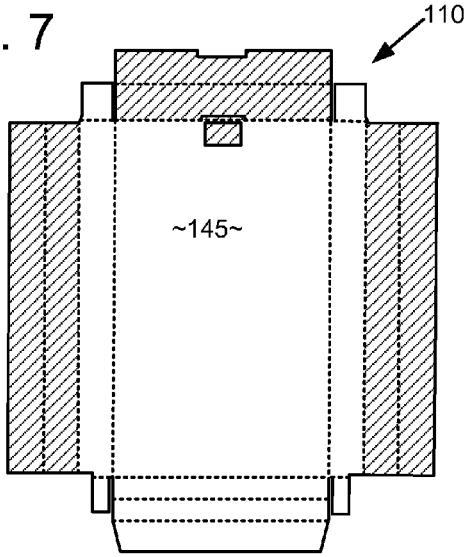
FIG. 7 is a plan view of the layout of an unassembled tray portion after diecutting.
Figure 6:
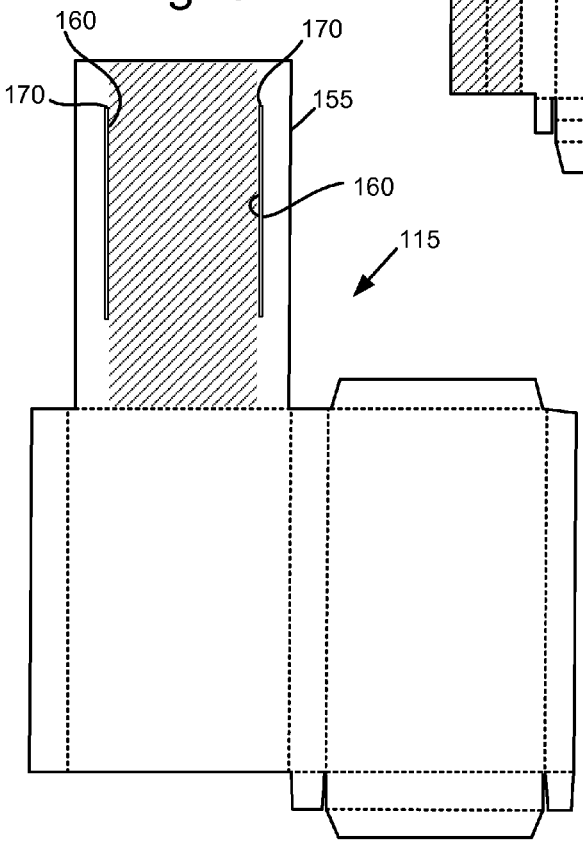
FIG. 6 is a plan view of the layout of an unassembled sleeve portion after diecutting.

FIG. 6 is a plan view of the layout of an unassembled sleeve portion 115 after diecutting or otherwise removing the material of the sleeve portion 115 from a sheet of cardstock or the like. FIG. 7 is a plan view of the layout of an unassembled tray portion 110 after diecutting or otherwise removing the material of the tray portion 110 from a sheet of cardstock or the like.

Having thus described the invention, what is claimed as new and desired to be secured by Letters Patent is:

1. A card holder assembly comprising:

a removable transaction card;

a tray including a bottom panel and at least one tray side panel;

a box sleeve including a front panel, where the tray is slidably received in the box sleeve;

an articulating connector panel comprising a tray segment, an intermediate segment, and a sleeve segment, where the tray segment is hingedly engaged to an interior facing surface of the bottom panel of the tray, the sleeve segment is hingedly engaged to an interior facing surface of the sleeve, and the intermediate segment is disposed between the tray segment and the sleeve segment, wherein the intermediate segment is hingedly engaged to the tray segment at a first fold line and the intermediate segment is hingedly engaged to the sleeve segment at a second fold line;

an articulating card panel having a first surface and second surface, where the first surface is configured to removably engage the transaction card and the second surface is engaged to the intermediate segment of the articulating connector;

wherein, in a closed configuration, the tray is disposed within the sleeve and the at least one tray side panel is proximal to the front panel, and wherein the first surface of the articulating card panel faces the interior facing surface of the bottom panel; and wherein, in an open configuration, the tray is translated away from the box sleeve and the first surface of the articulating panel faces away from the bottom panel.

2. The card holder of claim 1, whereby:

in the closed configuration, a first interior angle between the tray segment and the intermediate segment is obtuse and a second interior angle between the intermediate segment and the sleeve segment is acute; and in the open configuration, the first interior angle between the tray segment and the intermediate segment is acute and the second interior angle between the intermediate segment and the sleeve segment is obtuse.

3. The card holder of claim 2, wherein the articulating card panel rotates and protrudes from the card holder during a transition from the closed configuration to the open configuration.

4. The card holder of claim 1 further comprising a pull loop engaged to the at least one tray side panel.

5. The card holder of claim 1 wherein the sleeve segment of the articulating connector is slidably engaged to the front panel of the box sleeve, and where the front panel comprises a track panel positioned within the box sleeve, the track panel including one or more elongated slits to receive the sleeve segment, wherein the elongated slits limit a complete removal of the sleeve segment.

6. The card holder of claim 1 further comprising:

a removable header panel removably engaged to at least one of the tray or the box sleeve, where the transaction card is removably engaged to the header panel prior to attachment to the articulating card panel.

7. The card holder assembly of claim 1 further comprising a material loop attached to a sidewall of the tray; wherein the material loop protrudes out of the box sleeve portion when the tray portion is fully disposed within the box sleeve in a storage position.

8. A card holder assembly comprising:

a removable transaction card;

a generally rectangular sliding tray portion;

an outer sleeve portion that receives the tray portion, wherein the tray portion is fully disposed within the outer sleeve in a storage position;

an articulating panel disposed within said tray portion in the storage position, said articulating panel pivotally engaged to said tray portion and said sleeve portion, said articulating panel further configured to retain the removable card thereon using removable adhesive;

whereby, when said tray portion is withdrawn from said sleeve portion, said articulating panel rotates outward from said storage position towards said sleeve portion to a presentation position; and wherein the removable transaction card is retained upon a first surface of said articulating panel, said first surface facing a back panel of said tray portion when in said storage position, and whereby when said articulating panel pivots outward, said card engaged to the first surface and the first surface are rotated to an outward presentation position facing away from said back panel.

9. The card holder of claim 8, further comprising a header panel attached to the outer back surface of said sleeve.

10. The card holder assembly of claim 8 further comprising a material loop attached to a sidewall of the tray portion; wherein the material loop protrudes out of the outer sleeve portion when the tray portion is fully disposed within the outer sleeve in a storage position.

* * * * *